US006799716B1

(12) United States Patent
Kuelbs

(10) Patent No.: US 6,799,716 B1
(45) Date of Patent: Oct. 5, 2004

(54) SOLAR POWERED MAILBOX

(75) Inventor: Gregory G. Kuelbs, Westlake, TX (US)

(73) Assignee: World Factory, Inc., Southlake, TX (US)

( * ) Notice: Subject to any disclaimer, the term of this patent is extended or adjusted under 35 U.S.C. 154(b) by 0 days.

(21) Appl. No.: 10/443,290

(22) Filed: May 22, 2003

Related U.S. Application Data

(60) Provisional application No. 60/382,535, filed on May 22, 2002.

(51) Int. Cl.[7] ..... B65D 91/00

(52) U.S. Cl. ..... 232/39; 232/17; 232/45; 40/606.06; 40/559

(58) Field of Search ..... 232/39, 17, 45, 232/38; 40/566, 606.06, 559; 362/154, 812; D99/32

(56) References Cited

U.S. PATENT DOCUMENTS

| | | | | | |
|---|---|---|---|---|---|
| 808,764 | A | * | 1/1906 | Larsh | 40/606.15 |
| 1,435,379 | A | * | 11/1922 | Connery | 248/145 |
| 1,466,465 | A | * | 8/1923 | Belling | 40/607.12 |
| 1,495,741 | A | * | 5/1924 | Higdon, Jr. | 40/606.05 |
| 2,561,007 | A | * | 7/1951 | Bierig | 232/17 |
| D185,523 | S | * | 6/1959 | Wright | D99/31 |
| 3,802,619 | A | * | 4/1974 | Vanderveer | 232/17 |
| 4,416,414 | A | * | 11/1983 | Edgerton | 232/39 |
| 4,843,525 | A | | 6/1989 | Williams | |
| 4,905,891 | A | * | 3/1990 | Wildish et al. | 232/17 |
| D315,928 | S | | 4/1991 | Flieder | |
| D320,815 | S | | 10/1991 | Frost | |
| 5,143,285 | A | * | 9/1992 | Wise | 232/39 |
| 5,190,214 | A | * | 3/1993 | Dewailly | 232/39 |
| 5,435,087 | A | | 7/1995 | Karkar et al. | |
| 5,522,540 | A | | 6/1996 | Surman | |
| 5,570,000 | A | | 10/1996 | Kowalski | |
| D378,143 | S | | 2/1997 | Kollins | |
| 5,649,378 | A | * | 7/1997 | Roesser et al. | 40/559 |
| 5,695,113 | A | * | 12/1997 | Rau et al. | 232/34 |
| 5,713,514 | A | * | 2/1998 | Eck | 232/39 |
| 5,813,749 | A | | 9/1998 | Sheldon | |
| D413,704 | S | * | 9/1999 | Metchear, III | D99/32 |
| 6,004,002 | A | | 12/1999 | Giannone | |
| 6,513,284 | B1 | * | 2/2003 | Sandlin | 47/66.6 |
| 6,601,968 | B2 | * | 8/2003 | Voacolo | 362/154 |

* cited by examiner

*Primary Examiner*—William L. Miller
(74) *Attorney, Agent, or Firm*—Hill&Hunn LLP

(57) ABSTRACT

A mailbox having a direct illumination lighting system in which light is directed downward so as to shine on an address plate or other sign is disclosed. The lighting system is powered by rechargeable batteries that are recharged by a solar energy system. The solar energy system collects solar energy and converts it into electrical energy.

9 Claims, 6 Drawing Sheets

SOLAR POWERED MAILBOX

This application claims the benefit of U.S. Provisional Application No. 60/382,535, filed May 22, 2002, titled "Solar Powered Mailbox."

BACKGROUND OF THE INVENTION

1. Field of the Invention

The present invention relates to mailboxes. In particular, the present invention relates to lighted mailboxes.

2. Description of the Prior Art

Devices for lighting signs have been around for many years. Many of these devices are powered by rechargeable batteries that are recharged by solar energy systems. These devices can generally be categorized into two classes: backlit devices, and direct illumination devices. In backlit devices, the light fixture is typically enclosed in a housing, and the light shines through transparent or translucent panels to illuminate words or numbers printed on the panels. In direct illumination devices, the light fixture is carried by a housing that is positioned to shine light directly onto the words or numbers to be illuminated.

These solar powered backlit devices are typically limited in the size of the housing that can be used, due to the low power output of the rechargeable batteries, and due to the application in which they are used, i.e., usually to illuminate address numbers. Because these backlit devices usually form a self-contained housing, the solar panel is connected directly to the housing. This is a significant problem, because when the device is attached to the wall of a home to illuminate the address numbers, the amount of sunlight is frequently not optimum.

The direct illumination devices typically include bulky light fixture housings that are mounted above the signs to be illuminated. In some of the devices, the solar panels are mounted directly on top of the light fixture housing, and in other devices, the solar panels are remotely located. These light fixture housings can be quite unsightly, particularly when the solar panels are also connected to the housing.

The use of solar powered lighting systems to illuminate mailboxes has been limited to backlighting address numbers located in front of and directly connected to the mailbox, and to illuminating the inside of the mailbox. These devices do not illuminate the surrounding area below the mailbox, and are not capable of direct illumination of an address plate or other sign located below the mailbox.

Therefore, shortcomings remain in the area of solar powered mailboxes.

SUMMARY OF THE INVENTION

There is a need for a mailbox having a direct illumination lighting system and a rechargeable power source in which the rechargeable batteries are recharged by a solar energy system.

Therefore, it is an object of the present invention to provide a mailbox having a direct illumination lighting system and a rechargeable power source in which the rechargeable batteries are recharged by a solar energy system.

This object is achieved by providing a mailbox having a direct illumination lighting system in which light is directed downward so as to shine on an address plate or other sign. The lighting system is powered by rechargeable batteries that are recharged by a solar energy system. The solar energy system collects solar energy and converts it into electrical energy.

DETAILED DESCRIPTION OF THE INVENTION

Figure 1:
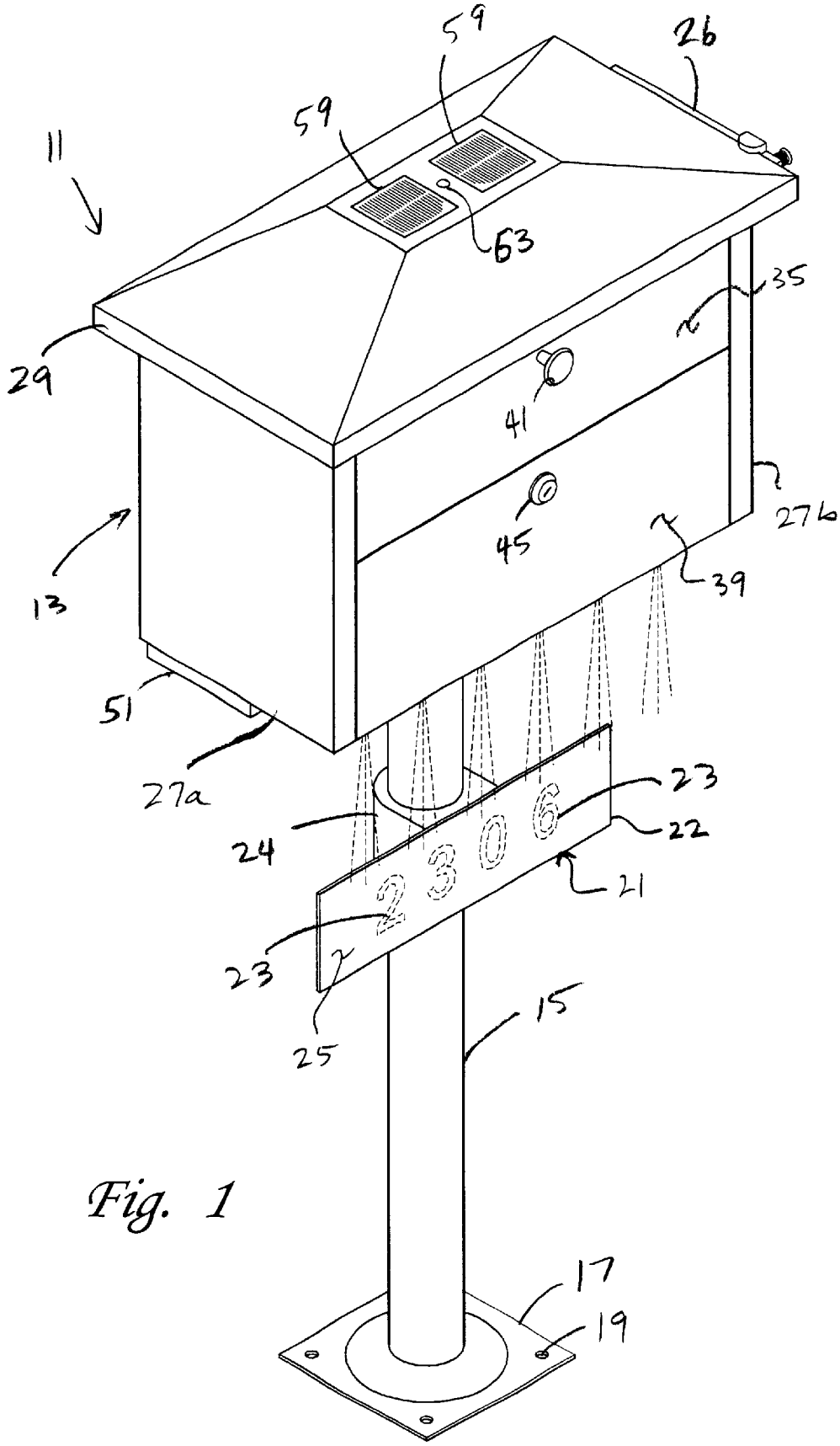
FIG. 1 is a perspective view of the solar powered mailbox according to the present invention.
Figure 2:
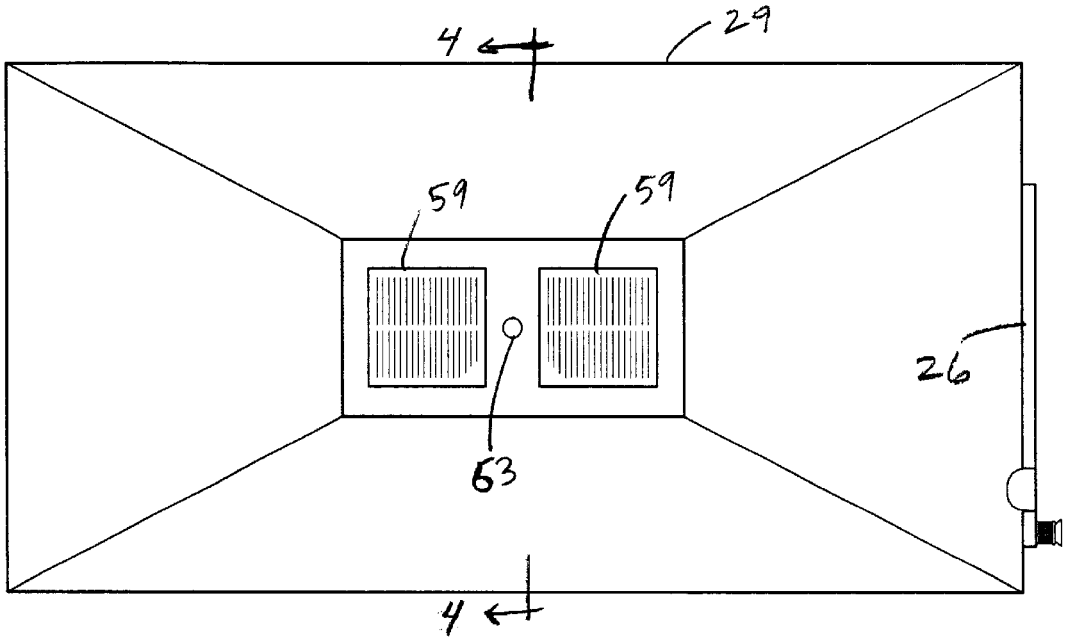
FIG. 2 is a top view of the solar powered mailbox of FIG. 1.
Figure 3:
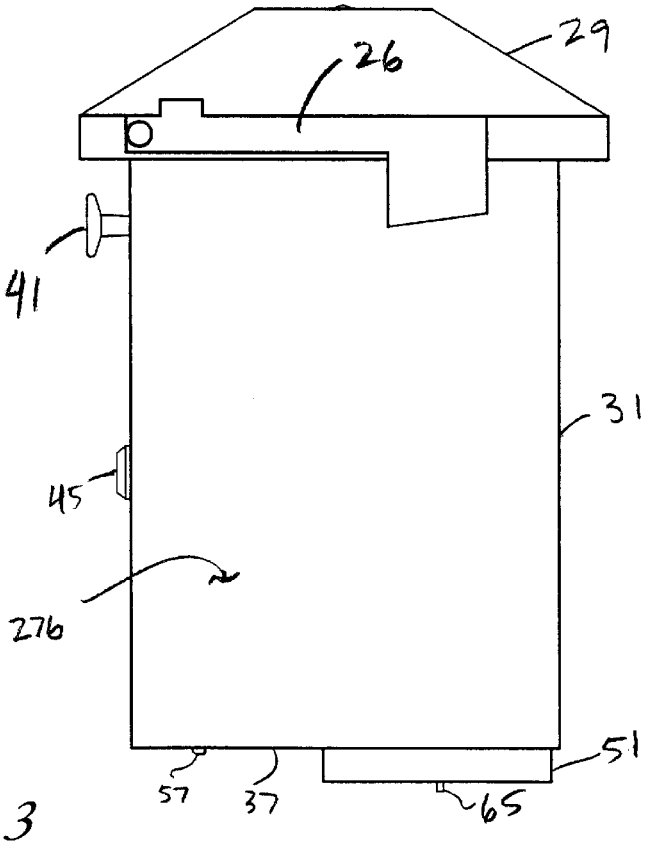
FIG. 3 is a left side view of the receptacle portion of the solar powered mailbox of FIG. 1.
Figure 6:
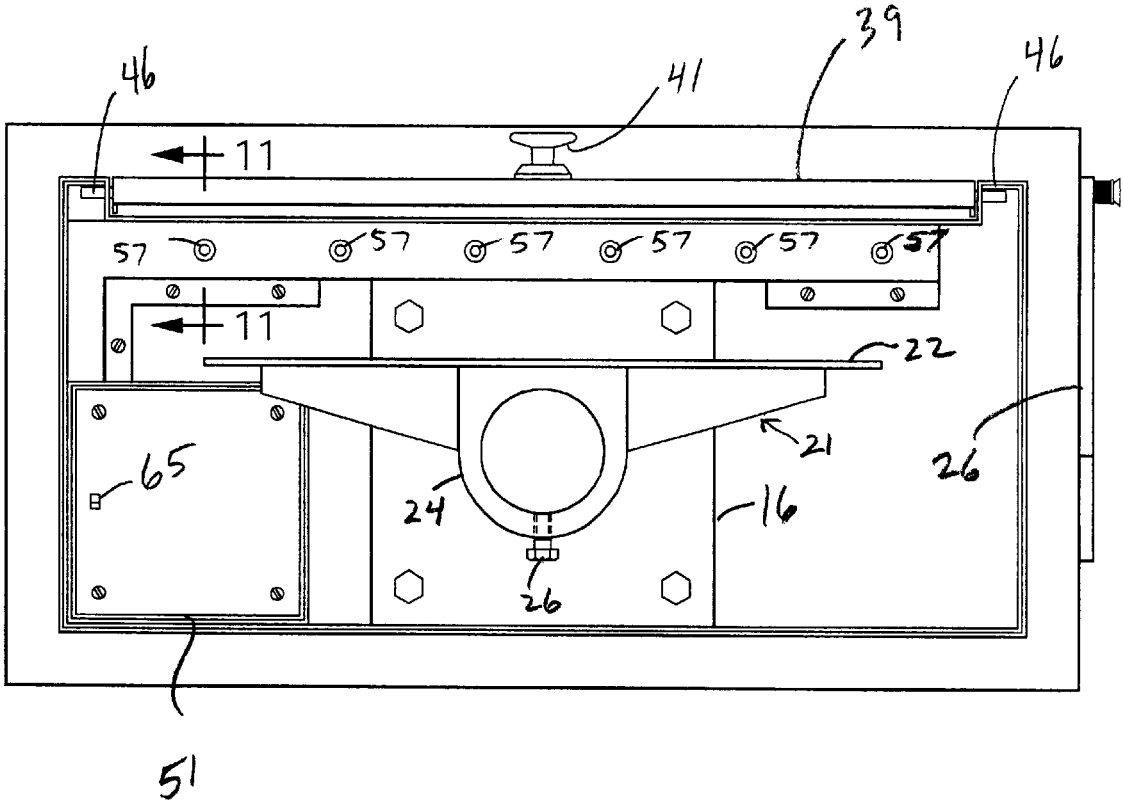
FIG. 6 is a bottom view of the receptacle portion of the solar powered mailbox of FIG. 1.
Figure 7:
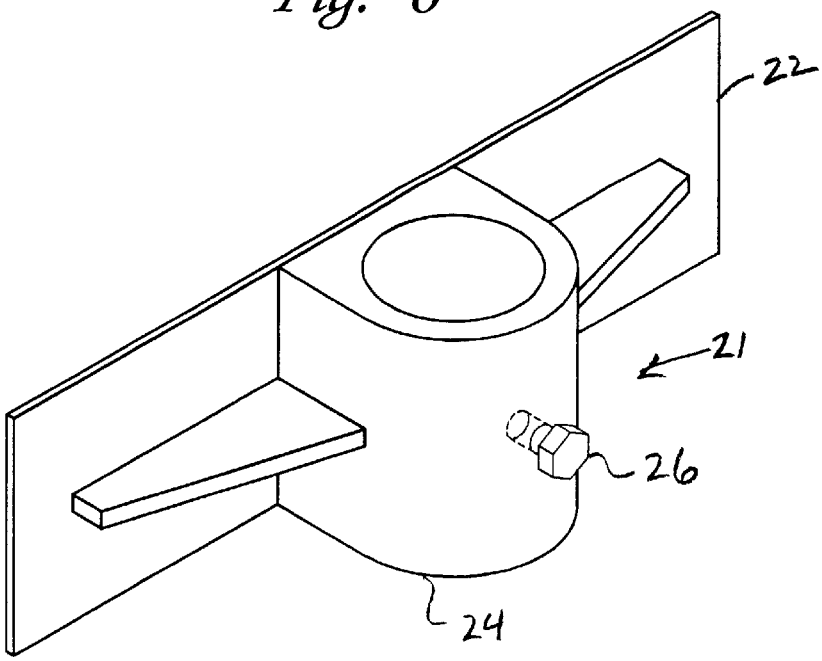
FIG. 7 is a rear view of the number plate of the solar powered mailbox of FIG. 1.
Figure 9:
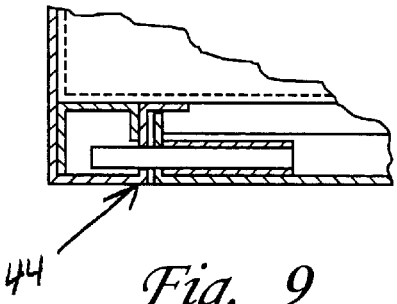
FIG. 9 is a cross-sectional view of an upper hinge member of the receptacle portion of the solar powered mailbox of FIG. 1 taken at 9—9 of FIG. 5.
Figure 11:
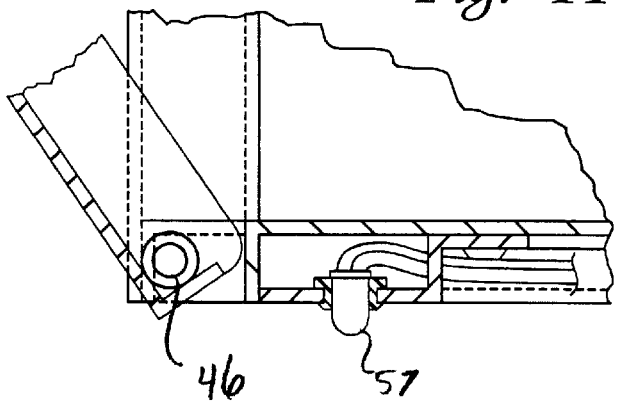
FIG. 11 is a cross-sectional view of a lower hinge member and LED of the receptacle portion of the solar powered mailbox of FIG. 1 taken at 11—11 of FIG. 6.
Figure 10:
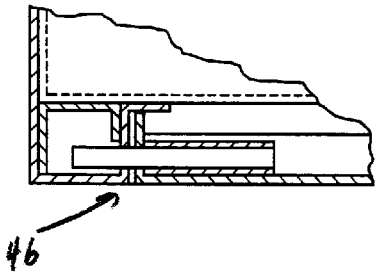
FIG. 10 is a cross-sectional view of a lower hinge member of the receptacle portion of the solar powered mailbox of FIG. 1 taken at 10—10 of FIG. 5.

Referring to FIG. 1 in the drawings, a solar powered mailbox 11 according to the present invention is illustrated. Mailbox 11 includes a receptacle portion 13 that is coupled to a mast portion 15, preferably at a top plate 16 (see FIG. 6). Mast portion 15 may terminate at a lower end with a base support member 17. Base support member 17 may include one or more mounting apertures 19 for securing base support member 17 to the ground or any other appropriate structure. An identification sign assembly 21 is carried by mast portion 15. Identification sign assembly 21 includes a front plate 22, an attachment portion 24, and an adjustment member 26. Identification indicia 23, such as a name, street number, or address, is visible on a front face 25 of identification sign assembly 21. Identification indicia 23 may be formed from a wide variety of materials, including tape, stickers, paint, various metals, plastic, and it should be understood that any of these materials may be coated, treated, painted, or finished to provide selected reflective properties. An outgoing mail flag 26 for indicating the presence of outgoing mail is carried by receptacle portion 13.

Referring now also to FIGS. 2–11 in the drawings, receptacle portion 13 is divided into an upper receptacle 13*a* and a lower receptacle 13*b*. Upper receptacle 13*a* is defined by side walls 27*a* and 27*b*, a roof member 29, a rear wall 31, an upper floor 33, and an upper door 35. Lower receptacle 13*b* is defined by side walls 27*a* and 27*b*, upper floor 33, rear wall 31, a lower floor 37, a lower door 39, and upper door 35.

Upper door 35 includes a handle 41 and a latching means 43*a* and 43*b*. In the preferred embodiment, upper door 35 is hingedly connected to side walls 27*a* and 27*b* by pinned hinges 44 (see FIG. 9), such that upper door 35 rotates forward and downward to allow access to upper receptacle 13*a* and lower receptacle 13*b* as will be explained in more detail below. It will be appreciated that upper door 35 may be hinged at other locations such that upper door 35 swings in other directions to open and close. Because upper door 35 does not include a locking means, upper receptacle 13*a* is accessible by the user, postal carriers, and others without the need for a key or unlocking means. Thus, the user may place outgoing mail in upper receptacle 13*a* to be picked up by a postal carrier, or the user may use upper receptacle 13*a* for pick-up's and deliveries by other people or carriers. It should be understood that upper door 35 may also include any suitable conventional locking means.

Figure 4:
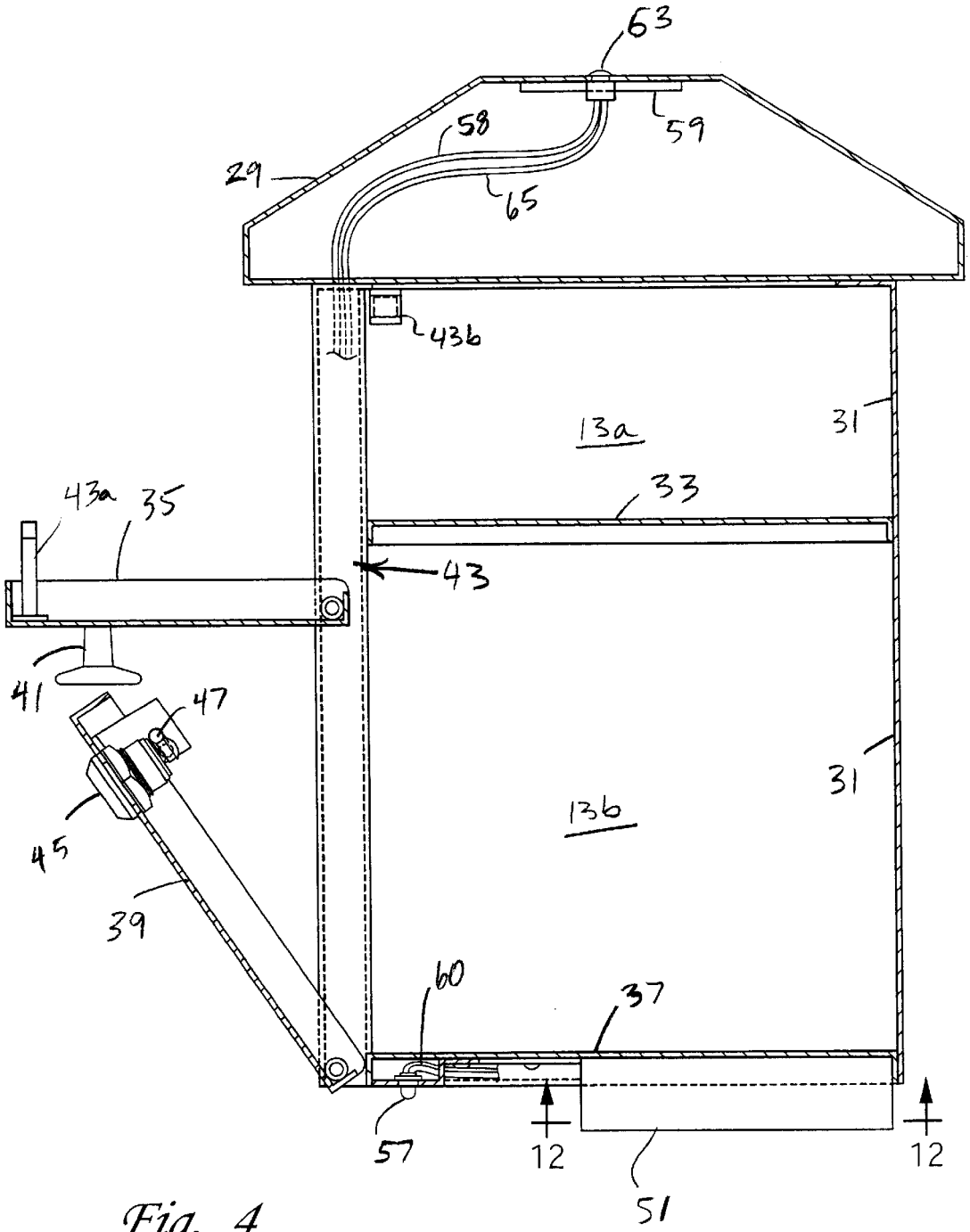
FIG. 4 is a cross-sectional view of the receptacle portion of the solar powered mailbox of FIG. 1 taken at 4—4 of FIG. 2 and shown in an open mode.

As is best seen in FIG. 4, upper door 35 is located and configured such that when upper door 35 is in the open mode, a narrow slot 43 exists to allow mail and other small packages to be passed therethrough into lower receptacle 13*b*. This is the preferred method of how postal carries would deliver the mail to mailbox 11.

Figure 5:
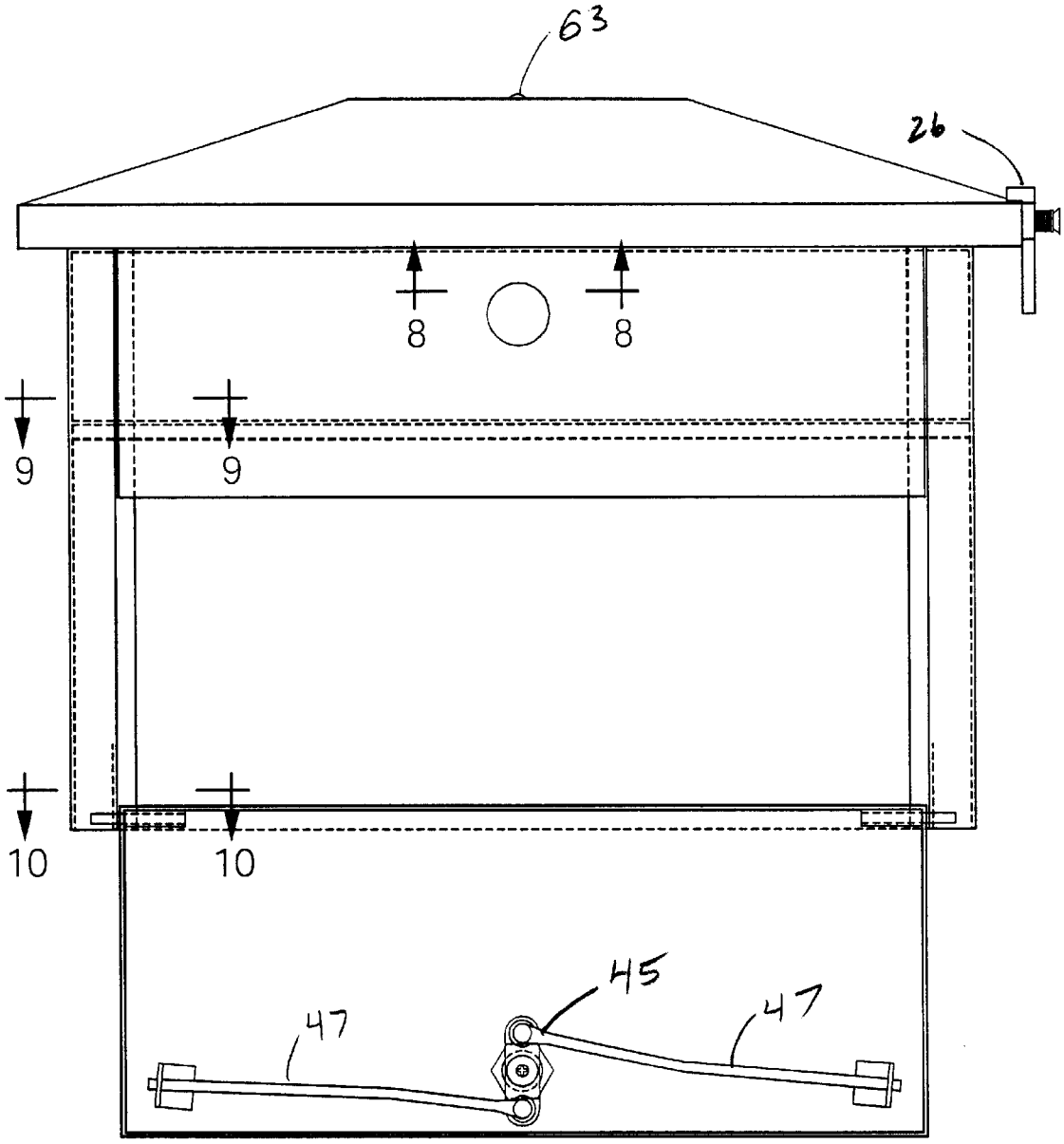
FIG. 5 is a front view of the receptacle portion of the solar powered mailbox of FIG. 1 shown in an open mode.
Figure 8:
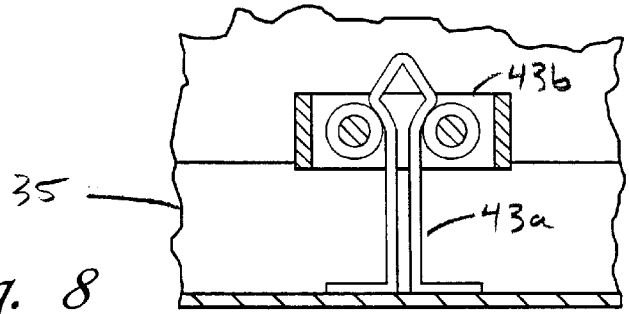
FIG. 8 is a cross-sectional view of the upper latch member of the receptacle portion of the solar powered mailbox of FIG. 1 taken at 8—8 of FIG. 5 and shown in a closed mode.

Lower door 39 includes a conventional locking means 45 that engages side walls 27*a* and 27*b* with extension arms 47 (see FIG. 5). In the preferred embodiment, lower door 39 is hingedly connected to side walls 27*a* and 27*b* by pinned hinges 46 (see FIG. 10), such that lower door 39 rotates forward and downward to allow access to lower receptacle 13*b*. It will be appreciated that lower door 39 may be hinged and locked at other locations such that lower door 39 swings in other directions to open and close. Because lower door 39 includes locking means 45, lower receptacle 13*a* is only accessible by the user or any other person who has an appropriate key or unlocking means. Thus, any mail or packages placed in lower receptacle 13*b* are secured until locking means 45 is appropriately unlocked.

Figure 12:
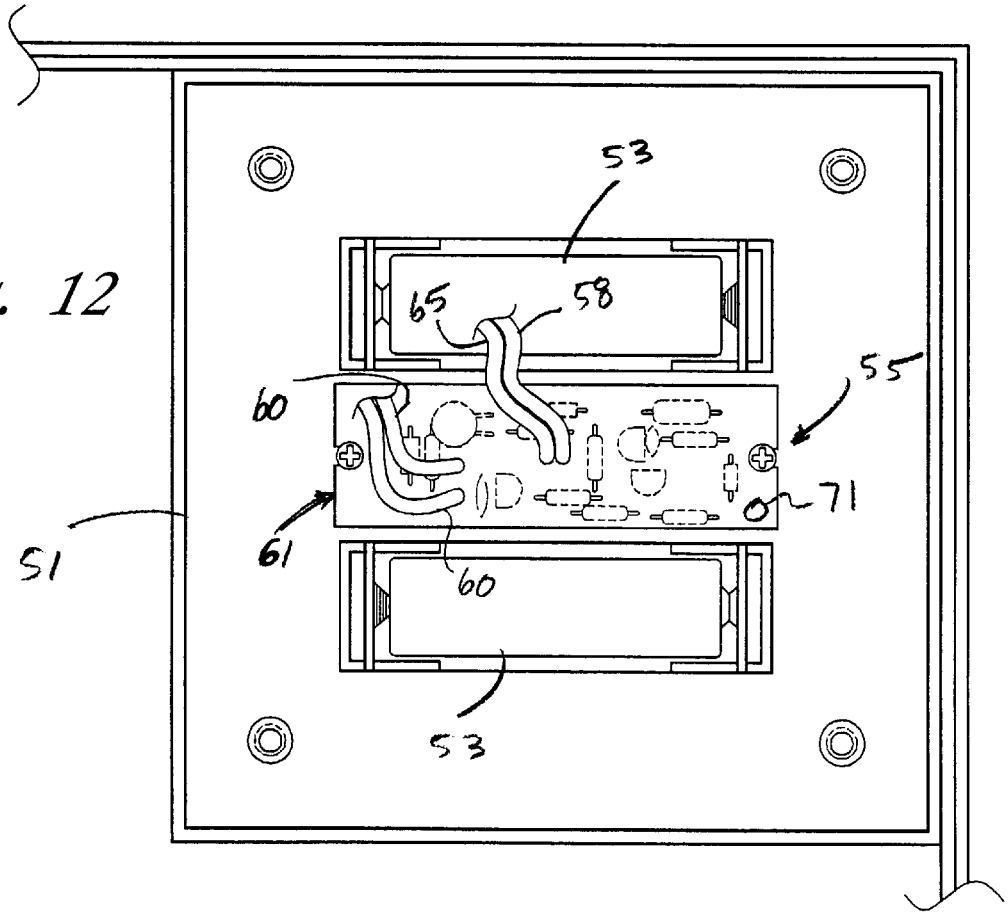
FIG. 12 is a cross-sectional view of the rechargeable battery pack and circuit board of the solar powered mailbox of FIG. 1 taken at 12—12 of FIG. 4.

Referring now also to FIG. 12 in the drawings, in the preferred embodiment, mailbox 11 includes a rechargeable electrical power source 51 that is recharged by solar energy to provide electrical power to mailbox 11. Rechargeable electrical power source 51 is preferably two 1.2-Volt rechargeable AA-size NiCd batteries 53 providing about 600 milliamps of current, but may be any of a wide variety of conventional rechargeable batteries. An electrical charging system and circuitry 55 is conductively coupled to rechargeable electrical power source 51.

The electrical power generated by rechargeable electrical power source 51 is used to illuminate a direct lighting system that is adapted to shine light directly down upon identification sign assembly 21 and the area surrounding identification sign assembly 21. The direct lighting system is preferably a plurality of lighting elements 57. Lighting elements 57 are conductively coupled to rechargeable electrical power supply 51 by wires 60. Lighting elements 57 are preferably located on mailbox 11 such that light generated by lighting elements 57 illuminates identification indicia 23 on front face 25 of identification sign assembly 21, as represented by the dashed lines in FIG. 1. In the preferred embodiment, lighting elements 57 comprise one or more light emitting diodes (LED's); however, it should be understood that lighting elements 57 may also be fluorescent lighting elements, cold cathode ray tube lighting elements, or any other suitable lighting element. It should be understood that rechargeable electrical power source 51 may be used to power a wide variety of electrical devices, such as microphones, radio receivers or transmitters, cameras, audio recording and playback devices, video recording and playback devices, loud speakers, other lighting elements, timing devices, remote controls, motors, etc.

At least one solar collector 59 is operably associated with mailbox 11 to collect solar energy for recharging rechargeable electrical power source 51. Solar collectors 59 are preferably disposed atop roof member 29 in a position to receive and collect the maximum amount of solar energy possible. Solar collectors 59 are conductively coupled via wires 58 to a conventional solar energy conversion system 61 that converts the solar energy to electrical energy. Electrical charging system and circuitry 55 and solar energy conversion system 61 use the electrical energy from solar collectors 59 to recharge rechargeable electrical power source 51.

An optional photoresistor 63 is operably associated with mailbox 11 and is conductively coupled to rechargeable electrical power source 51 by wires 65. Photoresistor 53 is also preferably disposed atop roof member 29. Photoresistor 53 detects the amount of light hitting mailbox 11 and provides a corresponding electrical signal that can be used to determine whether power is supplied to certain electrical components.

An optional on/off switch 65 is conductively coupled to rechargeable electrical power source 51 to provide a means to manually turn off the power to lighting elements 57 and any other electrical components that may be attached to mailbox 11. On/Off switch 65 is preferably disposed beneath lower receptacle 13*b*. In the preferred embodiment, on/off switch 65 overrides the switching functions of photoresistor 63. It should be understood that one or more on/off switches 65 and their corresponding control circuitry may be utilized to control the various electronic components on mailbox 11.

In the preferred embodiment, rechargeable electrical power system 51 includes a at least one port 71 for receiving an AC to DC power transformer. Thus, rechargeable electrical power system 51 is adapted to be recharged by connection to a conventional AC power outlet. Ports 71 may also be adapted for connection to receive power from a low-voltage power source, such as those used by landscape lighting systems. In addition, ports 71 may also be adapted for connection to other solar energy systems, such as those used by landscape lighting systems.

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the scope of the invention.

What is claimed is:

1. A mailbox comprising:

a mast portion;

a receptacle portion carried by the mast portion;

an identification sign assembly carried by the mast portion;

identification indicia disposed on the identification sign assembly;

a rechargeable electrical power system for providing electrical power to the mailbox;

a direct lighting system conductively coupled to the rechargeable electrical power system for shining light directly onto the identification sign assembly so as to illuminate the identification indicia, the direct lighting system comprising at least one lighting element disposed on the underneath side of the receptacle; and a solar energy system carried by the receptacle portion, the solar energy system being adapted to collect solar energy and convert the solar energy into electrical energy, the solar energy system being conductively coupled to the rechargeable electrical power system, such that the solar energy collected and converted into electrical energy recharges the rechargeable electrical power system.

2. The mailbox according to claim 1, wherein the rechargeable electrical power system is powered by at least one rechargeable battery.

3. The mailbox according to claim 1, further comprising:

an electrical charging system for recharging the rechargeable electrical power system, the electrical charging system being adapted to receive power from an AC power outlet.

4. The mailbox according to claim 3, wherein the electrical charging system is adapted to receive power from a DC power source.

5. The mailbox according to claim 1, wherein the lighting element is a light emitting diode.

6. The mailbox according to claim 1, wherein the lighting element is a fluorescent lighting element.

7. The mailbox according to claim 1, wherein the lighting element is a cold cathode ray tube lighting element.

8. The mailbox according to claim 1, wherein the receptacle comprises:

an upper receptacle defined by side walls, a roof member, an upper floor, a rear wall, and an upper front door;

a lower receptacle defined by a lower floor, a lower door, the side walls, the rear wall, and the upper floor; and a slot in the upper floor to allow access to the lower receptacle from the upper door.

9. The mailbox according to claim 8, further comprising:

a lock for securing the lower door in a closed position.

* * * * *